US007104029B2

(12) United States Patent
Tassin et al.

(10) Patent No.: US 7,104,029 B2
(45) Date of Patent: Sep. 12, 2006

(54) METHOD FOR CARRYING OUT A SIZE CHANGE OVER IN A PACKAGING MACHINE

(75) Inventors: Paolo Tassin, Vergato (IT); Antonio Orillo, Casalecchio di Reno (IT)

(73) Assignee: Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 10/509,313

(22) PCT Filed: Apr. 15, 2003

(86) PCT No.: PCT/IB03/01413

§ 371 (c)(1),
(2), (4) Date: Sep. 27, 2004

(87) PCT Pub. No.: WO03/091110

PCT Pub. Date: Nov. 6, 2003

(65) Prior Publication Data

US 2005/0210832 A1 Sep. 29, 2005

(30) Foreign Application Priority Data

Apr. 23, 2002 (IT) ..... B02002A0218

(51) Int. Cl.
*B65B 63/00* (2006.01)
*B65B 59/00* (2006.01)

(52) U.S. Cl. ..... 53/396; 700/112; 53/201

(58) Field of Classification Search ..... 53/201, 53/389.1–389.5, 396, 389.1–5; 700/112, 700/115, 116

See application file for complete search history.

(56) References Cited

U.S. PATENT DOCUMENTS

| | | | | |
|---|---|---|---|---|
| 6,588,173 | B1 * | 7/2003 | Moore et al. | 53/48.4 |
| 6,892,104 | B1 * | 5/2005 | Patil et al. | 700/95 |
| 2002/0198618 | A1 * | 12/2002 | Madden et al. | 700/101 |

* cited by examiner

*Primary Examiner*—Rinaldi I. Rada
*Assistant Examiner*—John Paradiso
(74) *Attorney, Agent, or Firm*—William J. Sapone; Coleman Sudol Sapone P.C.

(57) ABSTRACT

A method for carrying out and verifying substitution and/or adjustments of mechanical components in an automatic packaging machine (1) during the size change over, said machine (1) being equipped with a computerized unit (UCC, 2, D) for verifying and storing instructions related to the operations necessary to change over the size of the articles being processed. The operations include substitution of specific mechanical components and/or adjustment of the spatial positioning of specific mechanical components. Information elements relevant to the size change over are stored in the unit (UCC, 2D) and are recalled and transferred to a palm-size computer (3, E).

7 Claims, 2 Drawing Sheets

METHOD FOR CARRYING OUT A SIZE CHANGE OVER IN A PACKAGING MACHINE

TECHNICAL FIELD

The present invention relates to the technical field concerning automatic packaging machines for articles of different kinds.

In particular, the present invention relates to a method for carrying out and subsequently verifying substitutions and/or adjustments of mechanical components of an automatic packaging machine during the so-called "size change over", that is during the group of operations performed in order to allow the automatic packaging machine to work with articles and/or packages of different size and/or shape.

BACKGROUND OF THE INVENTION

Generally, when the size is to be changed in an automatic packaging machine, such as e.g. automatic machine for packaging articles into card-board boxes or the like, to which the present description will make explicit reference without losing its universality, some mechanical components or parts thereof must be absolutely substituted with others, whose dimensions allow to work with new articles to be packaged and/or with new boxes, while other components must be regulated/adjusted to the new positions, in order to suit to the new dimensions or shapes of the new articles and/or new boxes.

The above operations of substituting and/or adjusting of the mechanical components of the packaging machine are performed when the machine is off-work, and are usually quite complex, which results in the need of specialized staff.

Moreover, the substituting and/or adjusting operations must be performed in a sequence, which is well-determined in relation to different components to be substituted/adjusted, and usually is defined according to precise procedures contained in the packaging machine operation manual.

The operation manual also includes tables with identifying codes of new mechanical components which should replace the old ones, and which should be adjusted subsequently, so that they are easily found in the magazine.

The manual contains also tables with the values of new positions for each component which is only to be adjusted.

Therefore, during the size change over, the operator must only make constant reference to the sequence defined in the manual, and first of all, he/she must make constant reference to and remember the tables with the new identifying codes and the new positioning values.

In order to facilitate the size change over operations, in the current packaging machines the information related to the working sequence and to the tables of values contained in the manual, is stored in central control units (PLC or PC of the machine) of the packaging machines and thus it can be visualized on outer displays connected to the central units and fastened to the machine carrying structures.

The size change over procedures currently used require a lot of time, not only due to the complexity of the substitution and adjustment operations, but mainly because the operator must constantly consult the manual of the packaging machine, or anyway he/she must constantly make reference to the information visualized on the display of the machine central control unit.

Moreover, the above procedure in practice is not reliable, because adjustment errors of a mechanical component may occur if the operator forgets the exact new positioning value, or a component can be substituted with an incorrect one, if the operator erroneously interprets and memorizes the component identifying code written in the manual or visualized on the central control unit display.

Such errors result in an immediate stopping of the packaging machine, and in some serious cases, like for example in case of substitution of erroneous mechanical component, they can cause considerable damages to the machine.

SUMMARY OF THE INVENTION

The object of the present invention is to propose a method for carrying out and subsequently verifying the size change over operations in an automatic packaging machine, which allows avoiding the above mentioned drawbacks of the procedures used at present.

In particular, an object of the present invention is to propose a method, which allows, during the size change, carrying out substitutions and/or adjustment of new components of the automatic packaging machine in a simple and rapid way, thus reducing considerably the possibility of the technical operators' operation errors.

In accordance with the present invention, a method is proposed for carrying out and subsequently verifying substitutions and/or adjustments of mechanical components of an automatic packaging machine during a size change over, wherein the machine is equipped with a computer control unit for storing instruction related to the operations to be performed in order to carrying out the size change over, said operations including the substitution of defined mechanical components and/or adjustment of the spatial positioning of defined mechanical components; the method being characterized in that it includes recalling said stored information elements, related to the size change over, on the said computer control unit and transferring said information elements onto portable processing and computerized adjustment means, said portable means being equipped with means for detecting identifying codes associated to said mechanical components; displaying, on said portable means, of a list of mechanical components to be substituted and/or whose positioning is to be adjusted, together with information elements relevant to the mechanical components.

According to the proposed method, for each component to be replaced, the correctness of the component is checked by reading its identifying code by suitable means of the portable processing means and comparing the detected code with the information stored in the same portable processing means, the substituting component is then identified by reading and comparing a relative identifying code by suitable means of the portable means, and finally the component is substituted.

According to the proposed method, each component to be substituted is precisely defined by detecting, using reading means mounted on the portable processing means, the component identifying code and comparing it with the information stored in the portable processing means, then the information concerning values corresponding to a new positioning of the component is displayed on the portable processing means, and finally the component is adjusted according to the new positioning values, checking constantly the exact correspondence of the new values with the values displayed on the portable processing means.

BRIEF DESCRIPTION OF THE DRAWINGS

The invention will now be described in more detail with reference to particular, non-limiting embodiments and with reference to the accompanying drawings, in which.

BEST MODE OF CARRYING OUT THE INVENTION

Figure 1:
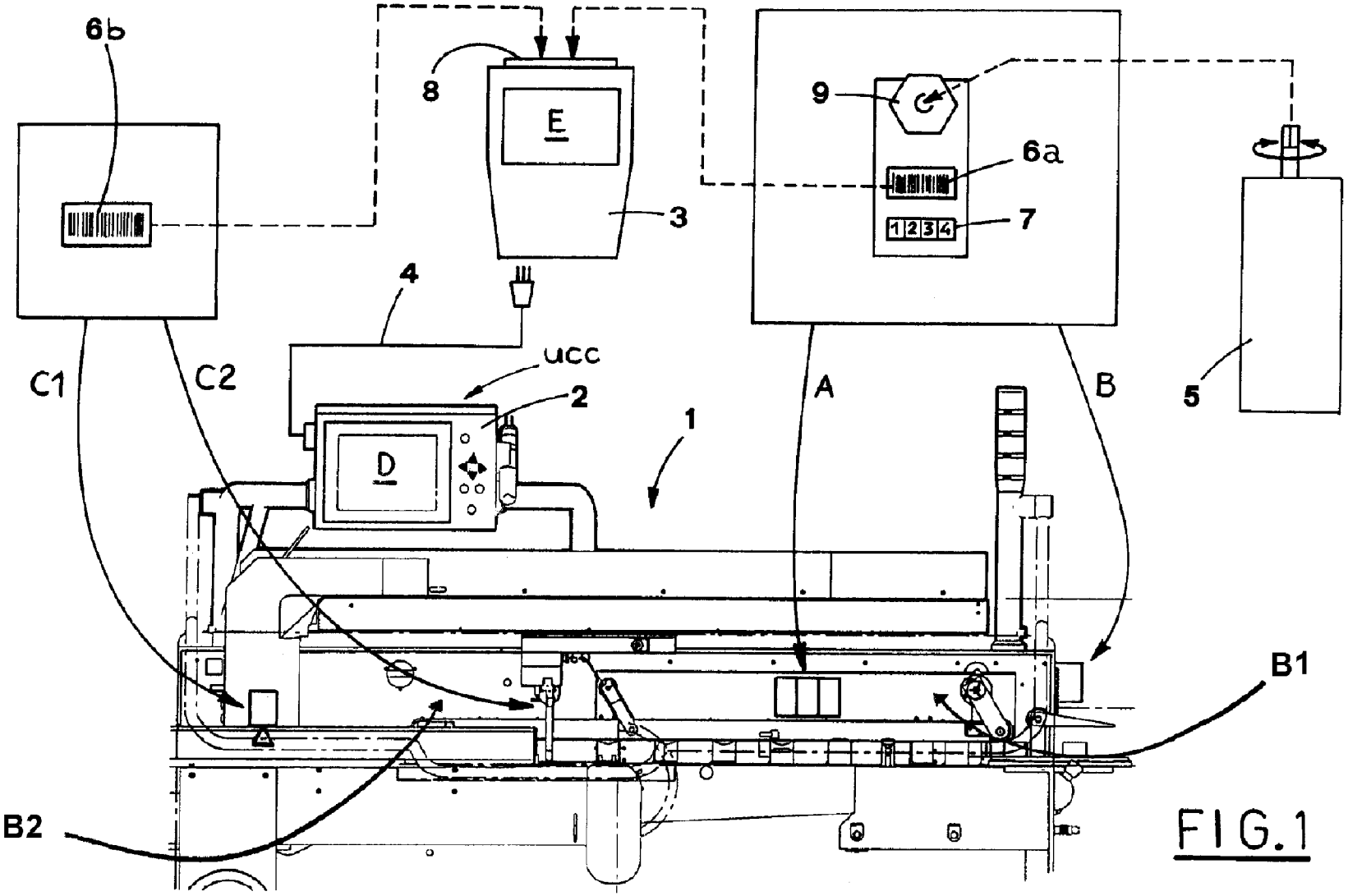
FIG. 1 is a schematic plan view of an automatic packaging machine, with some parts removed for sake of clarity and some others shown in an enlarged way, in which the proposed method is applied.

With reference to FIG. 1, the reference numeral 1 indicates an automatic packaging machine, more precisely, but without limiting, a packaging machine 1 for packaging articles into relative boxes made from cardboard or the like (not shown).

The machine 1 has the areas indicated respectively with A, B1 and B2, containing the working elements or mechanical components, which during the size change over must be substituted with others, whose dimensions allow to work with new articles to be packaged and/or new boxes, and the components which must be only regulated/adjusted to new positions, in order to suit to the new dimensions or shapes of the new articles and/or the new boxes.

More precisely, in FIG. 1 the reference letter A indicates the area of the machine 1 with mechanical components, like for example in FIG. 1, folding means of known type, which are aimed at folding edges or closing wings of the boxes heads.

These components have only spatial positioning to be adjusted by acting on known adjusting means 9 including worm screws, such as threaded rods which engages within suitable holes made on the folding means, to adapt them to the new dimension of the flaps or wings of the boxes having different size.

The reference letters B1 and B2 indicate respectively areas, in which it is necessary to substitute some mechanical components with others of suitable dimensions, such as in FIG. 1 a pick-up component equipped with suction cups aimed at removing, one by one, boxes in a blank configuration, from the bottom of a pile and at erecting the boxes (area B1) and, respectively, a pusher element, aimed at introducing articles into each box (area B2).

In particular, the means 9 for adjusting the positioning of the components situated in the area A, are connected to means 7 for checking the adjustment, such as in FIG. 1, numerical displays 7 of mechanical type, and are activated by the operator by means of a portable actuator 5 of known type, such as a re-chargeable battery powered screw driver.

Each component has a known type bar code 6*a*, whose function will be explained better in the following, situated near the means 9 for the component adjusting.

All the information elements necessary for the size change over, usually contained in the machine 1 operation manuals, such as information elements concerning the working sequence and the tables with adjusting values of different components associated to different sizes, with which the machine 1 works, are stored in the memory of a central control unit UCC (namely a PLC o PC equipped with serial port or Input/Output device) of the packaging machine 1, and can be selected via a keyboard 2 equipped with a mouse (not shown) and shown on a display or monitor D, connected to the unit UCC of the machine 1.

The method for carrying out substitution and/or adjustment of mechanical components, and for subsequently verifying them, according to the present invention and performed according to steps defined in the flow chart of FIG. 2, includes a first step, in which the operator recalls, on the computerized control unit UCC, the information and instructions concerning the substitution and/or adjustment of components related to a specified size of articles and/or boxes.

When the operator has confirmed the selection of the desired size, all the necessary information elements and working instruction are transferred to portable recording and processing means 3, through a serial connection "RS232" of known type between the unit UCC and the recording means 3, obtained by e.g. a serial cable 4.

Preferably, the recording and processing means 3 include a known palm-size computer 3, equipped with autonomous power supply, its own memory units, a microprocessor and keyboard input means, and a screen E for displaying the processed and stored data.

The palm-size computer 3 is connected to identifying codes reading means 8, for example a bar-code scanner of known type.

It is to be understood that also other data acquiring means can be used, without leaving the protective scope of the present invention.

When the information and instructions coming from the unit UCC have been stored in the memory of the palm-size computer 3, the palm-size computer is disconnected from the serial cable and the operator activates the data processing on the basis of a program, installed previously on the palm-size computer memories.

At this point, the operator can choose the option to follow the operation step sequence suggested automatically on the screen E of the palm-size computer 3 (FIXED OPTION), or the option to perform adjusting by beginning from any step chosen by the operator (RANDOM OPTION).

Figure 2:
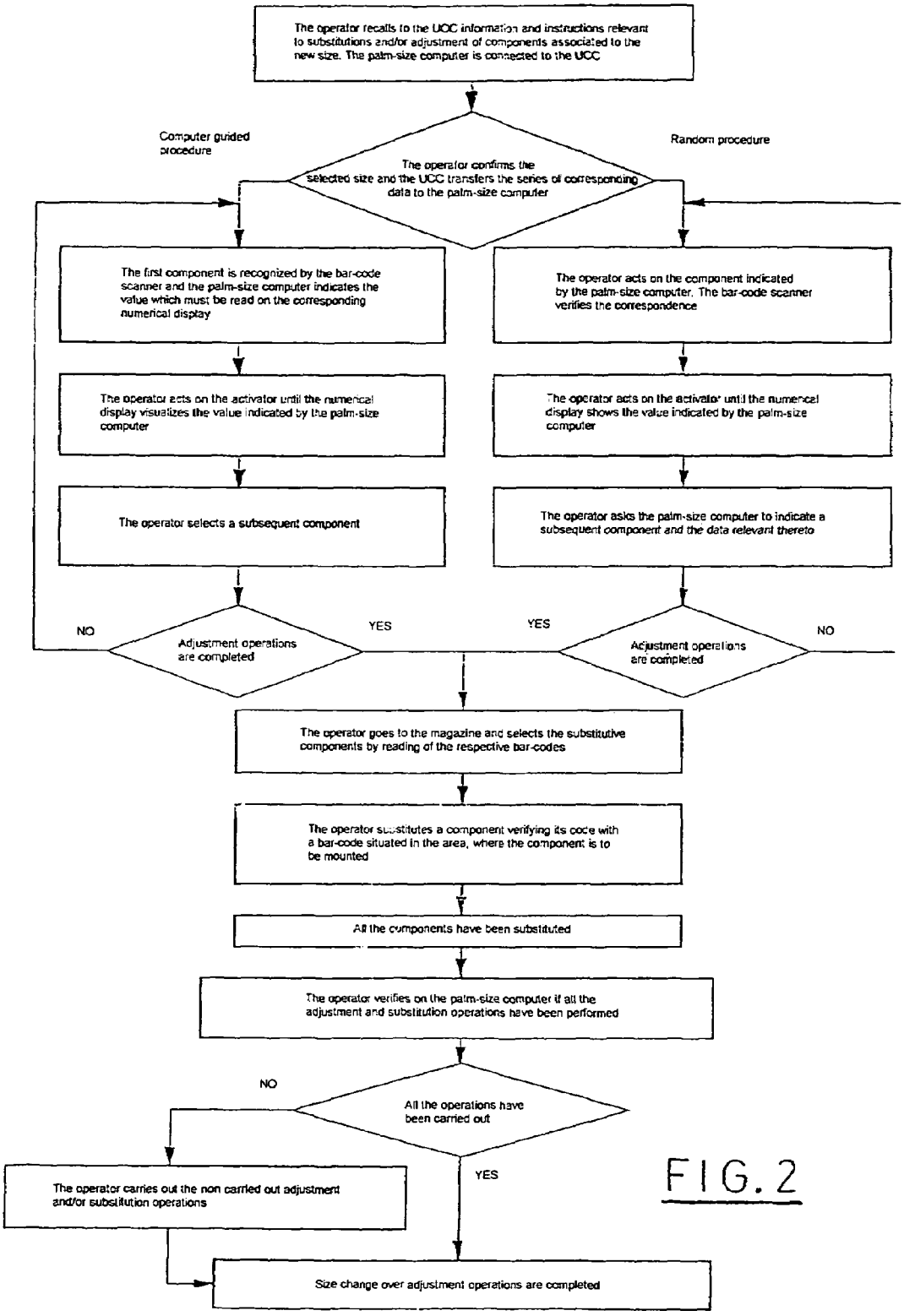
FIG. 2 is a flow chart, defining the operation steps of the method proposed by the present invention.

If the operator chooses the latter option, that is if the operator chooses to work according to the flow section situated on the left of the flow chart of FIG. 2, operation can proceed by acting an a first component, e.g. situated in the area A of the packaging machine 1.

The operator reads the bar-code 6*a* of the component to be adjusted by laying the bar-code scanner 8 of the palm-size computer 3.

The palm-size computer 3 compares the scanned bar-code with the instruction previously downloaded from the UCC and defines the values corresponding to an exact regulation of the component in relation to the chosen size.

Then, the operator acts, by the actuator 5, on the relative means 9, to adjust the component correct spatial positioning (height) until the display 7 shows the same value as the one indicated on the screen E: thus, the operator can read visually the exact correspondence between the two values as the confirmation of the perfect adjustment.

If a mechanical component does not have to be adjusted, the screen E shows the writing "NO CHANGE" and the indication of the current value.

The above working sequence is repeated likewise for each chosen component.

Otherwise, if the operator wants to follow an operation step sequence suggested automatically by the palm-size computer 3, that is according to the right part of the flow chart of FIG. 2, after having chosen this option, the operator finds the first component to be adjusted according to the instructions shown on the screen E.

After placing in position the bar-code scanner, the operator checks the exact correspondence of the component concerned with the indicated values.

After the regulation/adjustment has been performed in a way as described with reference to the component selected in accordance to the predetermined choice, the operator confirms the completion of the adjustment on the palm-size computer 3, so that the screen E of the computer shows the next component to be adjusted according to the sequence stored in the palm-size computer 3 memory.

The sequence of operations is repeated automatically for all components to be adjusted stored in the computer 3, until the whole adjustment operation is completed.

When the whole adjustment operation is completed, the screen E shows a list of all components, which have been adjusted in relation to the chosen size, so that the operator can advantageously check the correctness of the work performed, thus eliminating the possibility of errors caused by potential omissions.

When all the components situated in the area B have been adjusted, the screen E of the palm-size computer 3 visualizes a list of components to be substituted in the areas B1 and B2 of the machine 1.

The list includes the exact identifying code, indicated with 6*b* in FIG. 1, of each new component which should substitute the one used previously.

Then, at this point, the operator goes to the magazine to pick up the new mechanical components, and identifies exactly, by means of the bar-code scanner 8, each component to be picked up by reading its identifying code 6*b*, which is checked by the computer 3.

Afterwards, the operator returns to the machine 1 and substitutes the old components with the new ones, taken from the magazine, without any possibility of error.

Similarly to the above described adjustment of the components in the area A, when the whole substitution operation has been completed, the screen E visualizes a list of all the components substituted in relation to the chosen size, so that the operator can advantageously and rapidly check the correctness of the work performed, thus eliminating the possibility of errors caused by potential omissions.

As it is pointed out in the final part of the flow chart of FIG. 2, if any operation has been omitted, the operator is informed by e.g. a sound alarm, and the cycle is resumed to be definitely completed.

All the adjustments and substitutions are constantly recorded and updated in the memory of the UCC unit, so as to prepare the processing for a possible future size change.

Obviously, the order of the previously described procedure steps can be changed, i.e. it is possible to substitute the components first and to adjust the position of the components which do not have to be substituted afterwards.

The instructions and information are generally transferred from the UCC to the palm-size computer 3 in only one block by only one download operation.

In some cases, more download operations are possible, when the blocks of information are particularly large or when the memory of the palm-size computer 3 is limited.

Consequently, the use of portable recording and processing means, constituted by the palm-size computer 3 together with the bar-code scanner 8 and the bar-codes 6*a*, 6*b* prepared in the areas, where the substitution and/or adjustment operations are to be performed, makes it possible for the operator to perform these operations safely, without any risk of error, and extremely rapidly (up to 70% of time saved with respect to the normal size change over operations in a packaging machine).

Moreover, the possibility to guide the operator's actions and to establish an interaction between the operator and the recording and processing means, allows a path of the size change over operations to be traced through the most important steps, issuing, for each step and in any place and situation, information elements necessary for its best completion.

Following one by one the indications supplied by the palm-size computer 3 and applying the constantly updated measures visualized thereby, the operator can perform even more size change operations in one working day without the need of constant access to the UCC, without reporting in a notebook or memorizing a series of codes or measured values, and without re-calculating values which must appear on the numerical displays 7, as it occurs at present.

The invention claimed is:

1. A method for carrying out and subsequently verifying substitutions and/or adjustments of mechanical components in an automatic packaging machine during a change over to package products of a different size comprising:

providing a computerized unit for verifying and storing instructions related to each operation necessary for changing the automatic packaging machine for processing articles of different size, said operations including substitution of specific mechanical components and/or adjustment of spatial positions of specific mechanical components of said machine;

providing portable processing and recording means having code reading means for reading identifying codes associated with said specific mechanical components;

recalling information elements relevant to the size change over stored in said computerized unit and transferring said information elements for display on said portable means, said information elements being a list of mechanical components to substitute and/or components whose positioning is to be adjusted together with information elements relevant to the mechanical components;

reading the list, and locating the specific mechanical components to substitute and/or components whose positioning is to be adjusted, and, a) for each mechanical component to be substituted:

i) using said code reading means of said portable processing means for detecting said component identifying code on a mechanical component, comparing the detected code with the information elements stored in the processing means, and verifying the correctness of the mechanical component designated for substitution;

ii) using said code reading means of said portable processing means for detecting a substitute component identifying code on a mechanical component and comparing the substitute identifying code for verifying the identity of the substitute component; and, iii) substituting the verified substitute component on the machine;

b) and for each component whose position is to be adjusted:

i) locating the component to be adjusted, using said code reading means of said portable processing means for detecting said component identifying code, comparing the detected code with the information elements stored in the processing means, to verify that the correct component has been located;

ii) displaying on said portable processing means information elements relevant to a new positioning of the component to be adjusted; and iii) carrying out the adjustment of said component while verifying the exact correspondence of said adjustment with said information elements displayed on said portable processing means.

2. The method according to claim 1 wherein said component identifying codes are bar-codes situated on the components; and providing an optical scanner with said portable processing and storing means for reading the bar-codes.

3. The method according to claim 2 wherein said portable processing and storing means include a palm-size computer, and transferring the information elements from said computerized unit to said palm-size computer.

4. The method, according to claim 2 wherein said mechanical component is adjusted by displacing said mechanical component to said new position using adjusting means coupled to the mechanical component, said adjusting means being associated with means for displaying corresponding numerical values relative to said new position.

5. The method according to claim 1 wherein said portable processing and storing means includes a palm-size computer, and transferring the information elements from said computerized unit to said palm-size computer.

6. The method, according to claim 5 wherein said mechanical component is adjusted by displacing said mechanical component to said new position using adjusting means coupled to the mechanical component, said adjusting means being associated with means for displaying corresponding numerical values relative to said new position.

7. The method according to claim 1 wherein said mechanical component is adjusted by displacing said mechanical component to said new position using adjusting means coupled to the mechanical component, said adjusting means being associated with means for displaying corresponding numerical values relative to said new position.

* * * * *